United States Patent [19]

Delapierre

[11] Patent Number: 4,957,197

[45] Date of Patent: Sep. 18, 1990

[54] MACHINE FOR ARRANGING ARTICLES, SUCH AS CANS OF FOOD

[76] Inventor: Jean Delapierre, 38, rue d'Orival, 14000 Lisieux, France

[21] Appl. No.: 293,885

[22] Filed: Jan. 5, 1989

[30] Foreign Application Priority Data

Jan. 5, 1988 [FR] France ..... 88 00030

[51] Int. Cl.[5] ..... B65G 47/24

[52] U.S. Cl. ..... 198/394; 198/395; 198/379

[58] Field of Search ..... 198/394, 395, 379, 375, 198/376

[56] References Cited

U.S. PATENT DOCUMENTS

| | | | |
|---|---|---|---|
| 3,318,065 | 5/1967 | Shazor, Jr. | 198/394 X |
| 3,541,751 | 11/1970 | Quere et al. | 198/395 |
| 3,580,380 | 5/1971 | Phillips | 198/376 |
| 3,690,487 | 9/1972 | Evans, Jr. et al. | 198/395 X |
| 3,901,381 | 8/1975 | Quinn | 198/379 X |
| 3,902,594 | 9/1975 | Schmitt | 198/379 |
| 4,164,281 | 8/1979 | Schnier | 198/394 |
| 4,257,151 | 3/1981 | Coots et al. | 198/379 X |
| 4,428,474 | 1/1984 | Gau et al. | 198/376 X |
| 4,498,573 | 2/1985 | Anderson et al. | 198/375 X |

FOREIGN PATENT DOCUMENTS

| | | | |
|---|---|---|---|
| 2126757 | 4/1972 | Fed. Rep. of Germany | 198/379 |

*Primary Examiner*—Robert J. Spar
*Assistant Examiner*—D. Glenn Dayoan
*Attorney, Agent, or Firm*—Seidel, Gonda, Lavorgna & Monaco

[57] ABSTRACT

A machine for arranging groups of articles, such as cans of food, comprising an endless belt on which the articles to be combined, e.g. by a heat-shrink film, are disposed in rows, the machine being characterised in that it comprises a series of drive rollers adapted each to be applied against an article in a row in order to rotate it, detectors each disposed near an article of the row to be triggered by a reference on the article, each detector being connected to the corresponding drive roller for angular positioning of the references of all the articles to be arranged in groups and oriented in the row.

7 Claims, 2 Drawing Sheets

MACHINE FOR ARRANGING ARTICLES, SUCH AS CANS OF FOOD

BACKGROUND OF THE INVENTION

This invention relates to a machine for arranging articles, such as cans of food, into groups.

The machine comprises an endless belt on which the articles which are to be combined, for example, by means of a heat-shrink film, are disposed in rows.

SUMMARY OF THE INVENTION

The machine is characterised in that it comprises drive means adapted each to be applied against an article in a row in order to rotate it, detectors each disposed near an article of said row to be triggered by a reference on said article, each detector being connected to the corresponding drive means for angular positioning of the references of all the articles to be arranged in groups and oriented in the row.

According to another feature of the invention, the drive means and the corresponding detectors are disposed on a support movable perpendicular to the belt and the drive means including a roller for engaging the article and rotating it about an axis orthogonal to the plane of the belt.

According to another feature of the invention, the support of the drive means and detectors is made in two parts movable relatively parallel to the belt, one of said parts supporting the row of drive means, the other part supporting rollers mounted for free rotation, said rollers co-operating with rollers provided on the drive means to clamp between them an article for rotation thereof.

According to another feature of the invention, the two parts of the support are movable simultaneously in opposite directions.

According to another feature of the invention, the support is movable on a carriage through the agency of a drive means and in a direction perpendicular to the belt.

BRIEF DESCRIPTION OF THE DRAWINGS

The invention is illustrated by way of example without any limiting force in the accompanying drawings wherein.

DETAILED DESCRIPTION OF THE PREFERRED EMBODIMENT

The object of the invention is to provide a machine which will arrange articles, such as cans of food, bottles, etc., in a required orientation so that, for example, for the purpose of combining them by means of a shrink-film wrapping, they are all positioned angularly so that, for example, some parts of a label, such as the parts containing the mark, the most attractive decoration, product references, and so on, are visible at the same angle when these grouped articles are combined and, on the other hand, in order to conceal other parts of a label and, for example, that zone of the label which contains the bar code giving the article reference, so that this reference, which is applied individually to each article, cannot be taken into account, for example for invoicing, when these articles are grouped. In this case, the machine according to the invention so positions the articles that the label zones containing the bar codes are not disposed towards the outside of the pack of articles but, on the contrary, face the adjacent article of the group.

Figure 1:
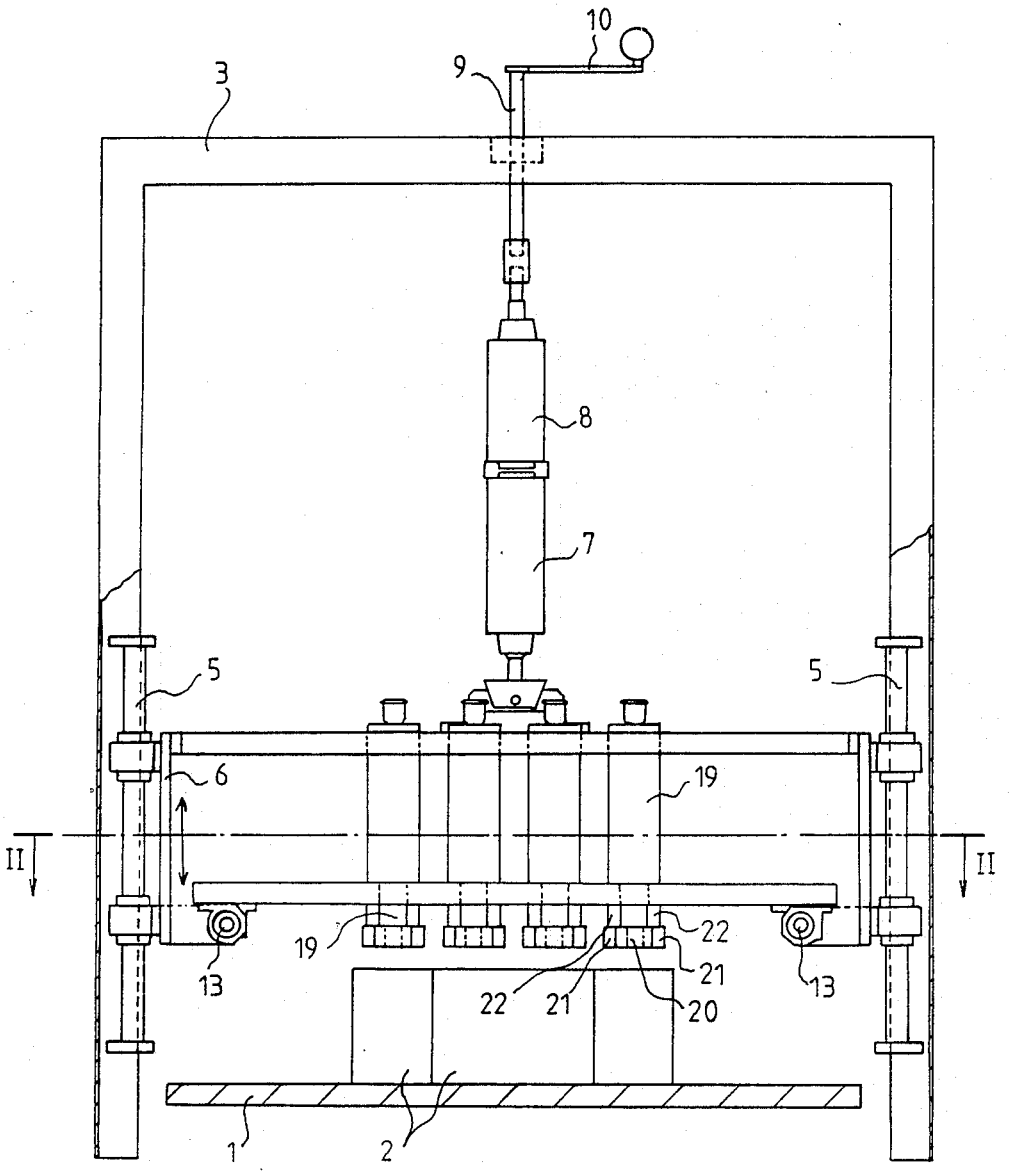
FIG. 1 is a side view of a machine according to the invention.

The machine comprises an endless belt 1, only the top run of which is shown in FIG. 1. The articles 2 which are to be arranged in groups are disposed in transverse rows on the belt 1, which moves continuously or intermittently.

Figure 2:
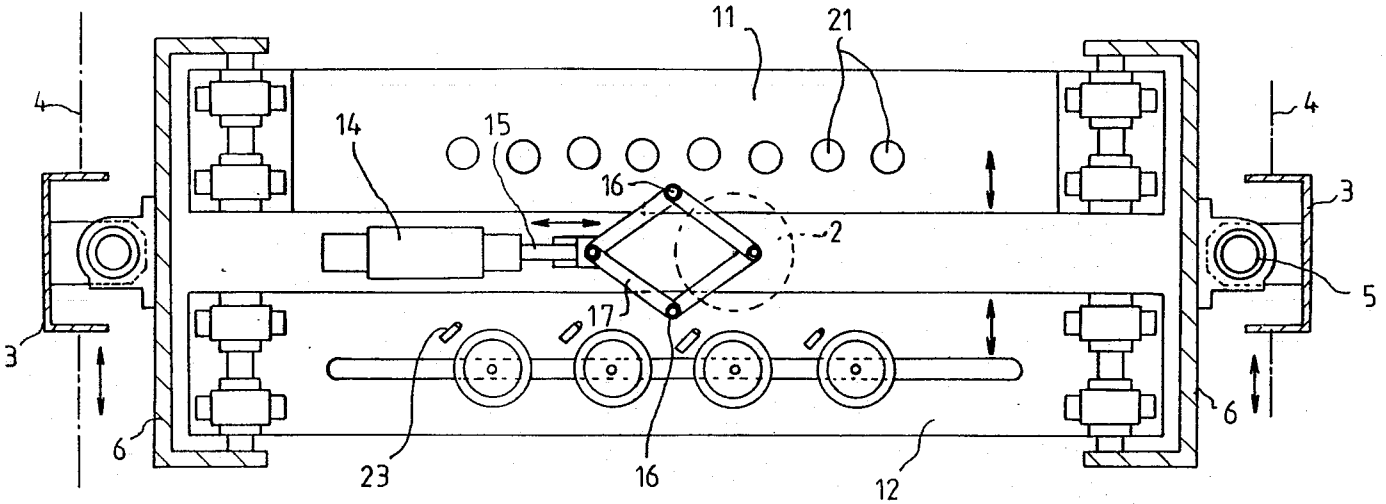
FIG. 2 is a section on the line II—II in FIG. 1.

A carriage 3 is mounted on the frame (not shown) of the endless belt. Carriage 3 is adapted to reciprocate parallel to the direction of movement of the belt 1 (see FIG. 2). Carriage 3 is driven to reciprocate along axes 4 in such manner that in one direction of movement it moves at the same speed as the endless belt 1. The mechanisms which provide this movement are not shown in the drawing, but they may readily be embodied, for example, by means of cams.

The carriage 3 comprises two columns 5 perpendicular to the belt 1. A support 6 is mounted on these columns 5. This support is movable on the columns 5, for example through the agency of two coaxial jacks 7 and 8 which connect the support 6 to the top part of the carriage 3. The coaxial jacks 7 and 8 are connected to the carriage 3 by means of a screwthreaded rod 9 driven by a crank 10 which allows adjustment of the height of the support 6 according to the height of the articles 2 requiring to be oriented.

The support 6 comprises two parts 11 and 12 movable horizontally relatively to one another in the direction of movement of the belt, for which purpose said parts 11 and 12 are mounted slidably on shafts 13 parallel to the direction of movement of the belt and mounted on the support 5. The parts 11 and 12 move simultaneously in opposite directions, for example by means of a jack 14 the rod 15 of which is connected at 16 to the two parts 11 and 12 by means of a linkage 17.

The part 12 of the support 6 supports the drive means 18, which are provided in a number equivalent to the number of articles for orientation. These drive means are, for example, pneumatic motors, whose shaft 19 oriented perpendicularly to the belt 1 is provided with rollers 20.

The part 11 facing said support 6 is provided with pairs of rollers 21 mounted for free rotation on shafts 22 oriented perpendicularly to the endless belt 1. Each pair of rollers 21 registers with a roller 20 so that after the support 6 has been lowered actuation of the jack 14 results in each of the articles 2 for orientation being clamped between a drive roller 20 and a pair of rollers 21.

Detectors 23 of any type are also provided on part 12. These detectors are adapted each to detect a reference provided on the articles so that they may thus all be positioned angularly.

The kinematics of the movements automatically produced by this machine are as follows: all the movements take place while the carriage 3 is moving in the same direction and at the same speed as the belt 1 on which transverse rows of articles are disposed.

At the start of the movement of the carriage 3 in the same direction and at the same speed as the belt 1, the support 6 guided by the columns 5 is lowered by the jack 7 until the rollers 20 and 21 are at the height of the articles 2. The jack 14 is then actuated to bring the two parts 11 and 12 together and clamp each can 2 between a drive roller 20 and a pair of rollers 21. The jack 8 is then actuated so as slightly to lift the support 6, which lifts the articles 2 with it, separating them from the belt 1. At the same time, the drive means 18 are rotated and this rotation continues until the articles are in the correct angular position and the machine performs the reverse movements, namely; actuation of jack 8 to lower support 6, actuation of jack 14 to move the parts 11 and 12 apart, actuation of jack 7 to lift support 6, the latter movement being affected before the return movement of the carriage 3 so that the rollers 20 and 21 do not obstruct the passage of the articles 20. It should be noted that for a faster movement cycle some of these movements may be performed simultaneously provided they do not interfere with one another.

It will be seen that the machine according to the invention allows identical angular positioning of all the articles of a group thereof, the articles being simultaneously rotated and the rotation of each of them being stopped on detection of their reference by a detector. This detection is not obstructed by the rotary drive or clamping means which occupy a fixed position with respect to the detectors during rotation of the cans.

Downstream of the machine in the direction of movement of the belt 1 are known means which themselves will pack the articles thus grouped and oriented in a heat-shrink film.

If the pack is to contain a plurality of rows of article, the support 6 may be designed to comprise a plurality of parts 11 and 12 juxtaposed in the direction of movement of the belt, in order that the articles in the various rows may be oriented identically or otherwise.

This arrangement will also be used if it is required to increase the speed of movement of the belt without excessively reducing the time required for the complete cycle for orientation of the articles.

If it is required to pack articles which are grouped in a plurality of rows in which the orientation of the articles differs from one row to another, it is also possible to provide a plurality of detectors 23 on the part 11 of the support 6 and for each drive means 18, and such detectors may or may not be differently positioned and detect the same reference of the articles or a different reference. In that case, these detectors will be operated successively to orient the articles of successive rows.

What I claim is:

1. A machine for the orientation of articles, such as cans of food, having a moving endless belt on which the articles to be combined are disposed, such as by means of heat-shrink film, the machine comprising: a carriage movable in a reciprocating movement parallel to the direction of movement of the moving endless belt, a support means disposed on the carriage, a series of drive means disposed on the support means, each said drive means adapted to engage and rotate an article, a series of detectors each disposed on the support means near the position of one article on the endless belt, each detector having a corresponding drive means operatively associated therewith, each detector being responsive to a reference on the article, each detector and corresponding drive means adapted to control the angular positioning of the reference on the article to arrange and orientate the article by rotation thereof, the support means having two parts, each part movable parallel to the direction of motion of the moving endless belt to clamp the articles laterally within the drive means for rotation thereof, the carriage including means for moving the drive means in a direction perpendicular to the belt.

2. A machine according to claim 1, wherein one of the support parts includes a row of drive rollers positioned transversely with respect to the direction of the belt movement, the other support part includes a series of idle rollers mounted for rotation, said idle rollers co-operating with said drive rollers to laterally clamp an article for rotation thereof.

3. A machine according to claim 2, wherein the drive means and the corresponding detectors are disposed on the same part of the support.

4. A machine according to claim 1, wherein the two parts of the support are movable simultaneously in opposite directions.

5. A machine according to claim 1 further comprising means for synchronizing the movement of the carriage with the belt so that the speed of the carriage, when moving in the same direction as the belt, is identical to that of the belt.

6. A machine according to claim 1, wherein the means for moving the drive means in a direction perpendicular to the belt includes two jack means, the first jack means causes the support means to clamp the articles on the moving endless belt, while the second jack means lifts the articles from the moving endless belt, thereby permitting the drive means to rotate the articles.

7. A machine according to claim 1, further comprising means for moving the carriage, drive means and support in the following pattern:

lowering the support from an initial position and positioning the drive means for rotating the articles;

bringing the two parts of the support together to clamp the articles within the drive means;

rotating the articles to their desired orientation determined by the detectors;

separating the two parts of the support; and returning the support to the initial position, the whole of said movements being effected while the carriage is moved in the same direction and at the same speed as the belt.

* * * * *